United States Patent [19]

Buschbom et al.

[11] 4,372,729

[45] Feb. 8, 1983

[54] TILT CONTROL

[75] Inventors: Floyd E. Buschbom, Long Lake; Donald L. Henke; Glen D. Hansen, both of Maple Plain, all of Minn.

[73] Assignee: Veda, Inc., Long Lake, Minn.

[21] Appl. No.: 170,597

[22] Filed: Jul. 21, 1980

[51] Int. Cl.[3] ..... E02F 3/86

[52] U.S. Cl. ..... 414/700; 414/706; 414/710

[58] Field of Search ..... 414/699-701, 414/708, 710, 713, 715; 37/DIG. 15

[56] References Cited

U.S. PATENT DOCUMENTS

| | | | |
|---|---|---|---|
| 3,009,590 | 11/1961 | Kampert | 414/700 |
| 3,032,215 | 5/1962 | French et al. | 414/700 |
| 3,155,253 | 11/1964 | Pilch | 414/701 |
| 3,180,504 | 4/1965 | Gruben et al. | 414/699 |
| 3,568,869 | 3/1971 | Beiley et al. | 414/701 |
| 3,695,474 | 10/1972 | Blakely | 414/700 X |
| 3,713,557 | 1/1973 | Seaberg et al. | 414/700 |
| 3,738,522 | 6/1973 | Cecchi | 414/701 |
| 3,792,792 | 2/1974 | Bromberek | 414/700 |
| 3,794,199 | 2/1974 | Bromberek et al. | 414/700 |
| 3,811,587 | 5/1974 | Seaberg | 414/708 X |
| 3,872,990 | 3/1975 | York | 414/700 |
| 3,987,920 | 10/1976 | Parquet et al. | 414/700 |

*Primary Examiner*—Robert J. Spar
*Assistant Examiner*—Terrance L. Siemens
*Attorney, Agent, or Firm*—Burd, Bartz & Gutenkauf

[57] ABSTRACT

A motor vehicle equipped with lift arms and a bucket for handling material. The vehicle has a fluid power system including piston and cylinder assemblies to pivot the lift arms between down and up positions and tilt the bucket relative to the lift arms. A bucket leveling control apparatus operates a fluid control valve in response to the pivotal movement of the lift arms to control the flow of fluid to the bucket tilting piston and cylinder assembly to maintain the bucket substantially level during the movement thereof between down and up positions. The fluid control valve is operable to supply fluid under pressure to the bucket tilt piston and cylinder assembly to move the bucket to a dump position.

47 Claims, 7 Drawing Figures

93
36
44
63
87
88
129
131
29
31
62
89
32
41
66
139
128
123
124
121
59
58
64
122
68
125
126
69
57
61
127
49
71
53
54
55
67
52
51

TILT CONTROL

SUMMARY OF INVENTION

The invention is related to a control apparatus operable to maintain a selected position of a first member movably mounted on a second member. More particularly, the control apparatus is associated with lift arms pivotally mounted to a material handling vehicle and a bucket pivotally mounted on the lift arms. First fluid power means are operable to pivot the lift arms relative to the vehicle from a down position to an up position. Second fluid operated means mounted on the lift arms are operably connected to the bucket to control the pivotal or tilting movement of the bucket relative to the lift arms. The control apparatus has mechanical linkage means responsive to the relative movement between the lift arms and the vehicle frame and the relative movement between the bucket and the lift arms to automatically control a valve in a manner to regulate the flow of fluid to the second fluid operated means to maintain the bucket substantially level as the lift arms move up and down between up and down positions. The linkage means has a first arm movable in response to movement of the bucket relative to the lift arms and a second arm for controlling the valve connected to the vehicle frame and the first arm so that the combined movement of the lift arms and relative movement between the bucket and lift arms operates the valve to maintain a selected orientation of the bucket. Preferably, the selected orientation is a generally horizontal or level position of the bucket. Adjustable means associated with the second arm is used to change the selected orientation of the bucket.

An object of the invention is to provide a control apparatus that automatically controls the position of a second member relative to a first member in response to pivotal movement of the first member. Another object of the invention is to provide a control apparatus for automatically changing the position of a material holding means to maintain a selected orientation of the material holding means during movement of the holding means between up and down positions and providing means for adjusting the selected orientation of the material holding means. A further object of the invention is to provide a material handling vehicle having lift arms attached to a bucket with an automatically operated control apparatus that maintains the bucket substantially level during movement of the lift arms between up and down positions. A further object of the invention is to provide a material handling vehicle having lift arms and material accommodating means with a control apparatus that controls the flow of fluid to a piston and cylinder assembly to maintain the material accommodating means in a material holding position during the movement thereof by the control arms between up and down positions. Yet another object of the invention is to provide a material handling vehicle having lift arms and a bucket pivotally mounted on the lift arms with a bucket leveling control apparatus that automatically operates to maintain the level position of the bucket during movement of the control arms and does not interfere with the dumping of the bucket. These and other objects and advantages of the invention are shown and described in the following detailed specification.

IN THE DRAWINGS

DESCRIPTION OF PREFERRED EMBODIMENT

Figure 1:
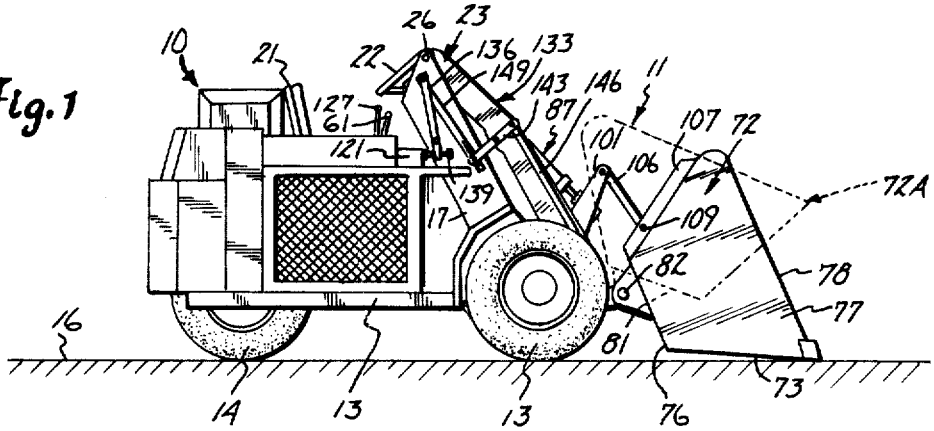
FIG. 1 is a side elevational view of a material handling vehicle equipped with the control apparatus of the invention for orientating a bucket mounted on lift arms pivotally connected to the vehicle.
Figure 3:
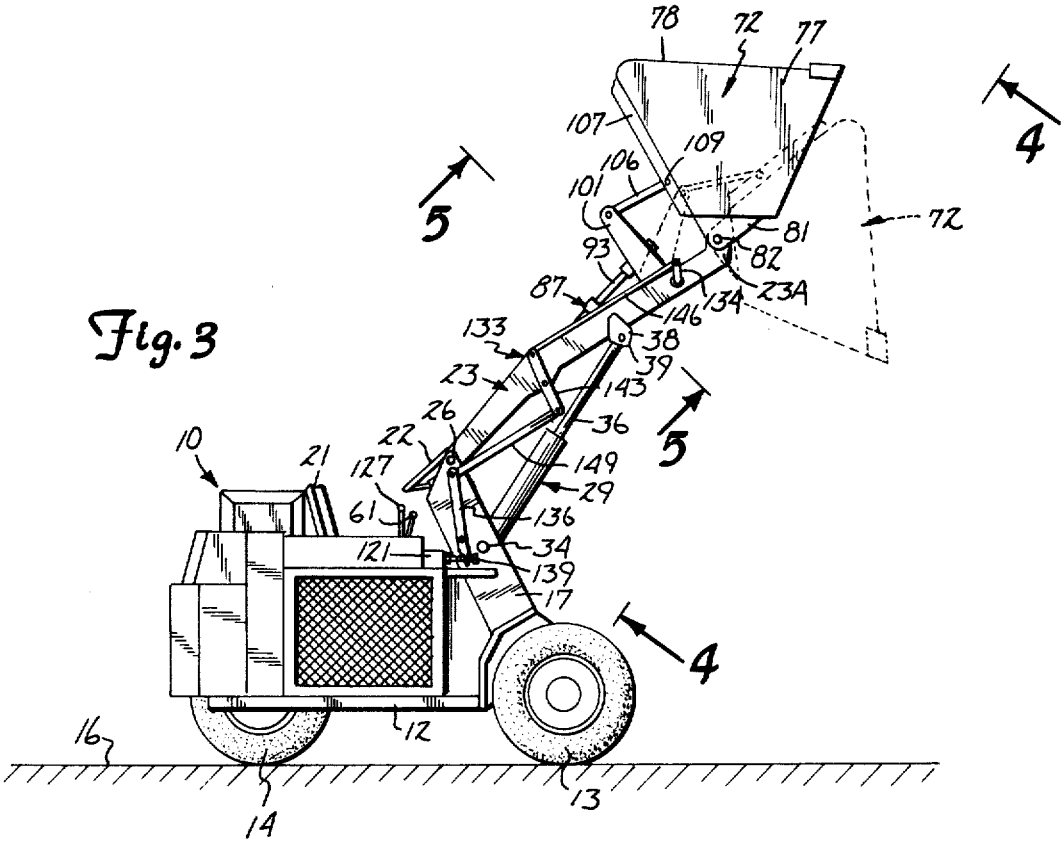
FIG. 3 is a side elevational view of the material handling vehicle showing the lift arms and buckets in the up position.

Referring to FIGS. 1 and 3, there is shown a motor vehicle indicated generally at 10 equipped with a material handling apparatus 11 for picking up, transporting, and dumping bulk material, such as fertilizer, sand, gravel, grain, dirt, and the like. Vehicle 10 has a frame 12 operatively connected to a pair of front drive wheels 13 and a rear steerable drive wheel 14. Each wheel 13 and 14 is powered with a fluid operated motor operably connected to a pump assembly (not shown). An internal combustion engine drives the pump assembly. The fluid drive and control system for the vehicle is disclosed in co-pending U.S. patent application Ser. No. 169,191. The fluid drive system of co-pending U.S. patent application Ser. No. 169,191 is incorporated herein by reference.

Rear wheel 14 is arcuately movable about a generally upright axis to steer the vehicle. A power means (not shown) mounted on the vehicle frame is used to arcuately move wheel 14. The power apparatus is a fluid operated system disclosed in co-pending U.S. patent application Ser. No. 165,745. The fluid steering control for wheel 14 of co-pending U.S. patent application Ser. No. 165,745 is incorporated herein by reference.

Figure 4:
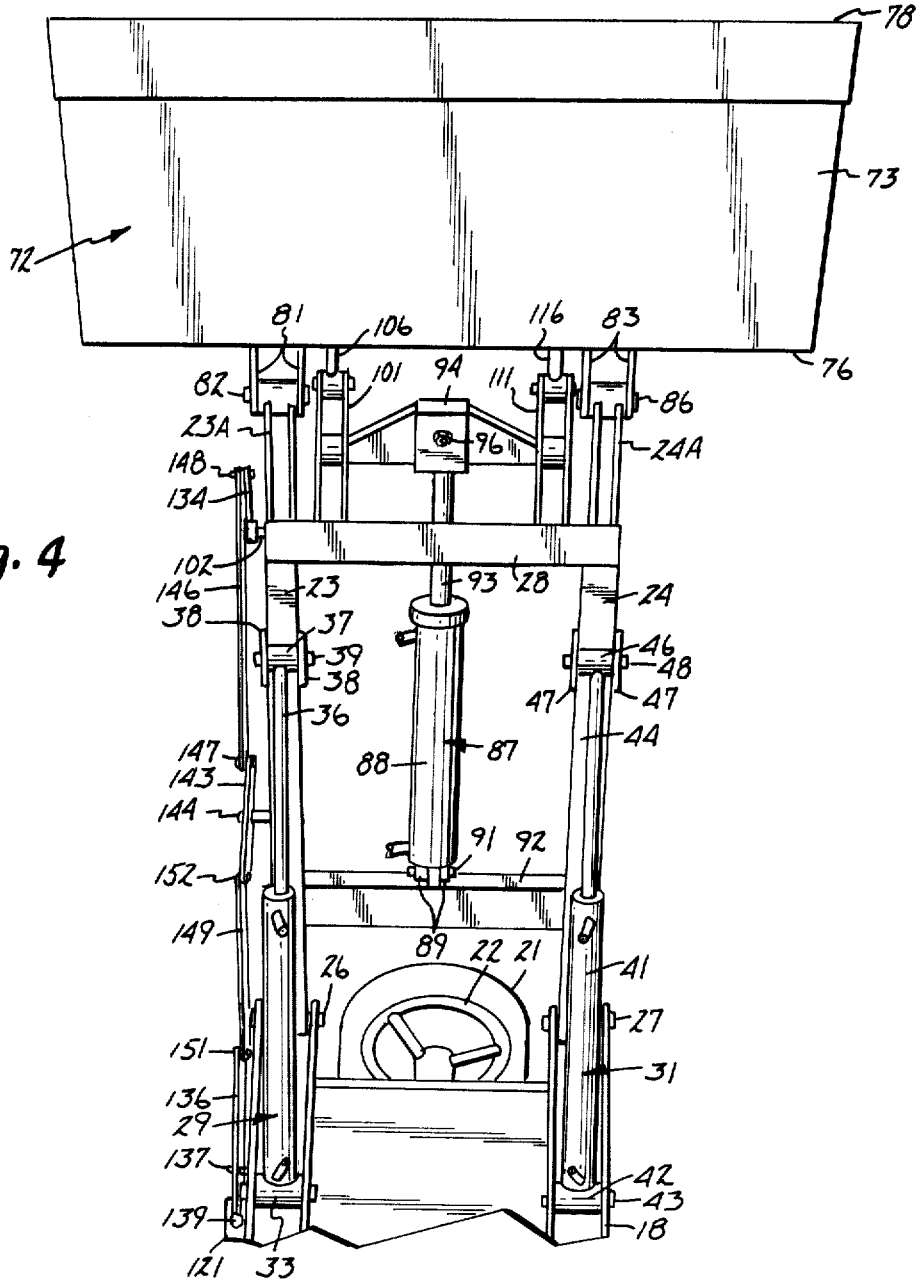
FIG. 4 is a front perspective view looking along the line 4—4 in the direction of the arrows in FIG. 3.

A pair of upwardly and rearwardly inclined posts 17 and 18 are secured to the front of frame 12 adjacent the wheels 13. As shown in FIG. 4, the posts are generally U-shaped and have upright channels open in a forward direction. A transverse panel 19 extends between and is secured to posts 17 and 18. A seat 21 is located rearwardly of the panel for accommodating the vehicle operator. A steering wheel 22 is rotatably mounted on panel 19 in front of seat 21. Steering wheel 22 is operatively connected to a valve unit forming part of the hydraulic control circuit for the power means operable to arcuately turn steerable wheel 14.

Material handling apparatus 11 includes a pair of lift arms 23 and 24 pivotally mounted on the upper ends of posts 17 and 18 with pivot pins 26 and 27, respectively. Pins 26 and 27 have a common transverse axis allowing the lift arms to arcuately move in a generally vertical plane from the lower or down position to an up or raised position. A cross member 28 is secured to the outer ends of lift arms 23 and 24. The pivot movement of lift arms 23 and 24 are controlled with an expandable and contractible means comprising a pair of double acting hydraulic piston and cylinder assemblies indicated generally at 29 and 31 in FIG. 4. Piston and cylinder assembly 29 has an elongated cylinder 32 secured at its lower end to the transverse sleeve 33 accommodating a pivot pin 34 pivotally connecting cylinder 32 to the mid-section of post 17. A movable piston rod 36 projects upwardly from cylinder 32 and is attached at its outer end to a transverse sleeve 37. Sleeve 37 is located between a pair of ears 38 secured to and projected downwardly from an outer portion of arm 23. A pin 39 pivotally connects sleeve 37 to ears 38. The second piston and cylinder assembly 31 has an elongated cylinder 41 attached at the lower end to a transverse sleeve 42. A pin 43 pivotally connects sleeve 42 to the mid-section of post 18. A movable piston rod 44 projects upwardly from cylinder 41. The outer end of rod 44 is attached to a transverse sleeve 46 interposed between a pair of ears 47 attached to an outer end of arm 24. A transverse pin 48 pivotally connects sleeve 46 to ears 47. The pin 48 is located in general alignment with the pin 39 so that piston and cylinder assemblies 29 and 31 operate concurrently to provide a common force to raise and lower lift arms 23 and 24.

Figure 6:
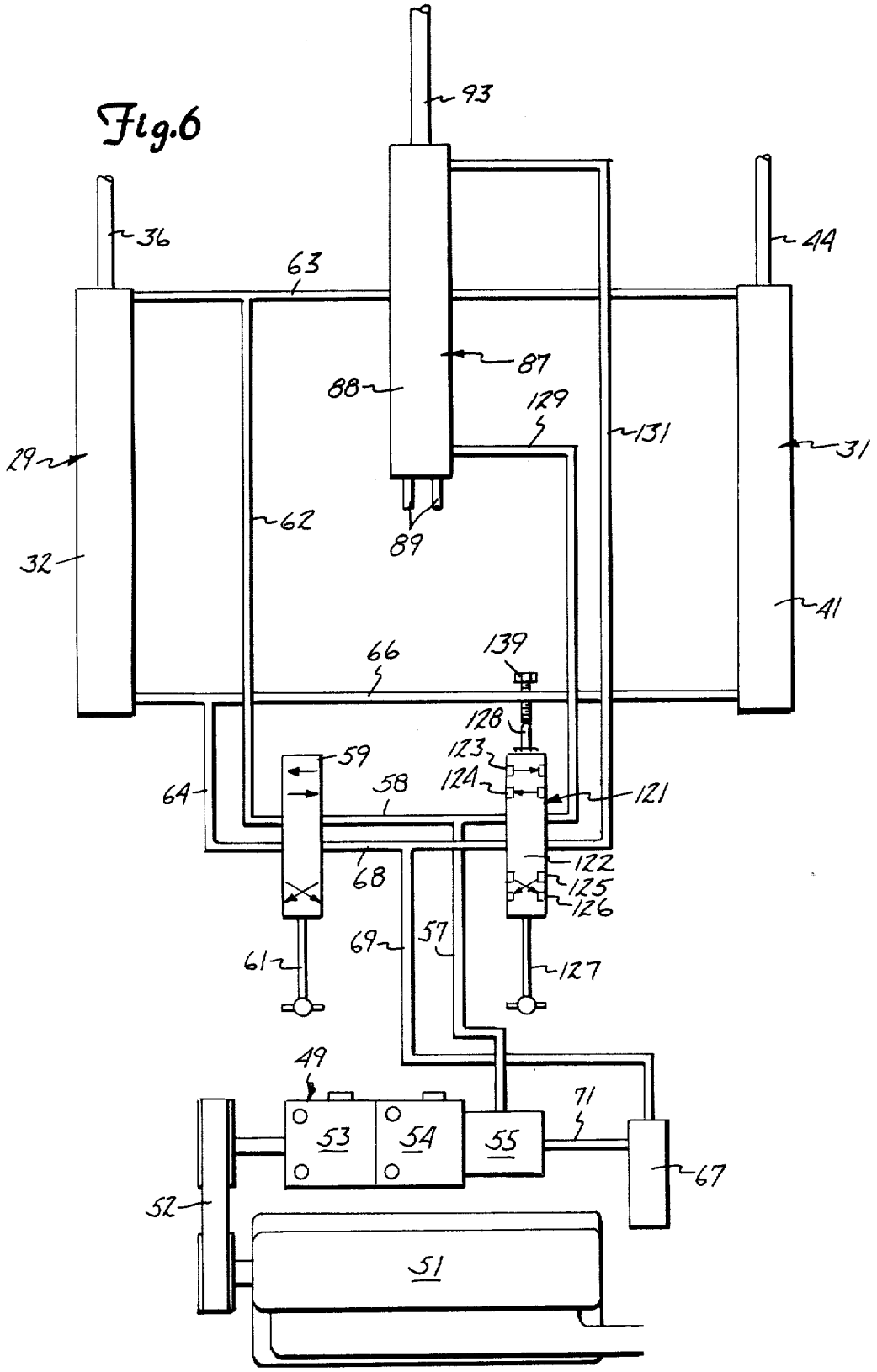
FIG. 6 is a diagrammatic view of the fluid control circuit for the lift arms and bucket.

Referring to FIG. 6, a pump assembly indicated generally at 49 is driven by an internal combustion engine 51. A belt and pulley power transmission 52 operatively connects engine 51 with pump assembly 49. The pump assembly 49 and engine 51 may be mounted on a sub-frame secured to frame 12 of the vehicle. A sub-frame for supporting the pump assembly 49 and engine 51 is disclosed in U.S. patent application Ser. No. 170,145. This application is incorporated herein by reference.

Pump assembly 49 has three axially aligned pumps 53, 54, and 55 operatively coupled to a common driven shaft 56. Pumps 53 and 54 are identical variable positive displacement hydraulic pumps operably connected to supply fluid under pressure to the front wheel drive motors and the rear wheel drive motor, respectively. Pump 55 is an auxiliary or third pump used to supply fluid under pressure to the power steering means and the piston and cylinder assemblies used to control the material handling apparatus. Pump 55 delivers fluid under pressure to lines 57 and 58 connected to a manually operated spool valve 59. Valve 59 has a manual lever control 61 operable by the operator of the vehicle to selectively control the flow of fluid to the opposite ends of the arm pivoting piston and cylinder assemblies 32 and 41.

Lines 62 and 63 connect valve 59 to the rod ends of cylinders 32 and 41. Lines 64 and 66 connect valve 59 to the lower or base ends of cylinders 32 and 41. Valve 59 is operable to selectively supply and drain fluid, such as oil, from opposite ends of the cylinders 32 and 41 and thereby control the movement of piston rods 36 and 41 which, in turn, controls the angular position of lift arms 23 and 24. Valve 59 is connected to a fluid reservoir 67 with a line 68. Line 69 connects the reservoir with the pump 55.

Referring to FIGS. 1–4, an open top bucket indicated generally at 72 is pivotally connected to the outer ends of arms 23 nd 24. Bucket 72 has an outwardly and forwardly inclined front wall spaced from a generally upright back wall 74. Front wall 73 and back wall 74 are secured to a bottom wall 76 and generally upright side walls 77. The front wall 73, back wall 74, and side walls 77 have a top edge 78 surrounding the open top of bucket 72. Bucket 72 is a material accommodating means. Other types of material accommodating means can be associated with the lift arms 23 and 24 to lift and transport material and objects.

Figure 5:
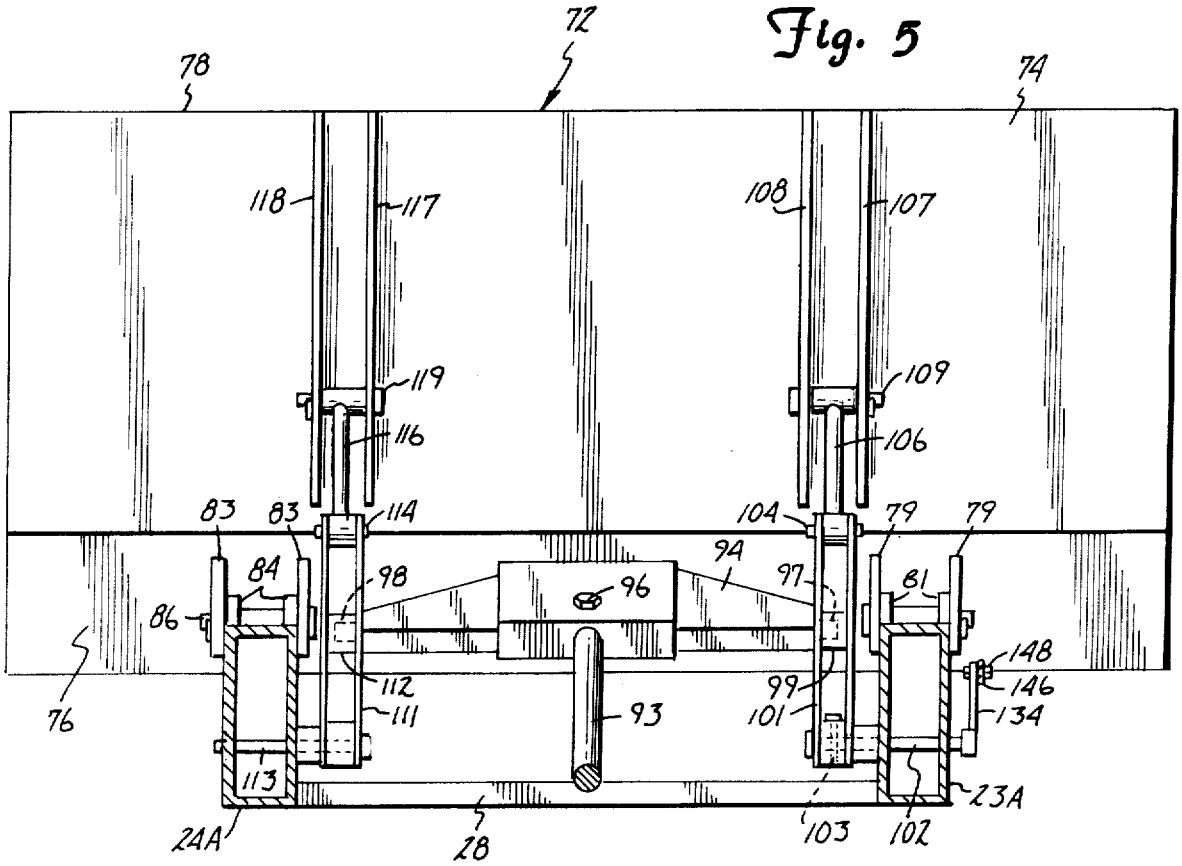
FIG. 5 is an enlarged sectional view taken along the line 5—5 of FIG. 3.
Figure 7:
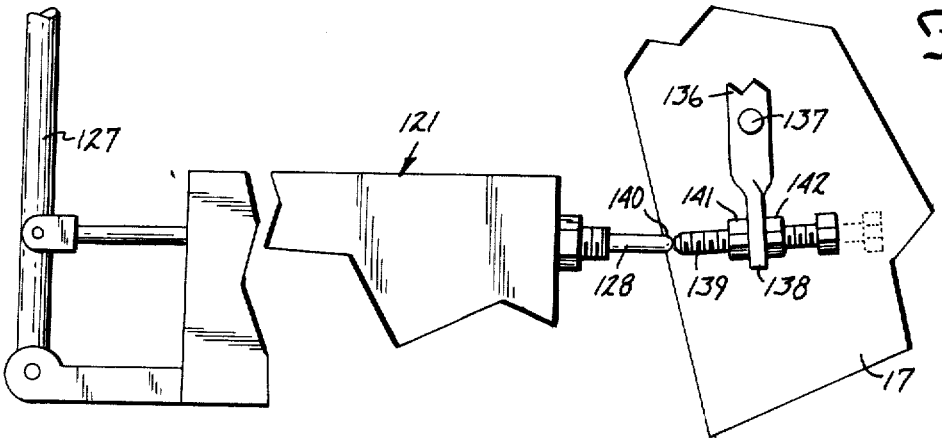
FIG. 7 is an enlarged fragmentary side elevational view showing the adjustable bolt between the bucket leveling control linkage and tilt cylinder valve.

Bucket 72 is pivotally mounted on outer ends 23A and 24A of the lift arms 23 and 24, respectively. As shown in FIGS. 5 and 7, a first pair of ears or brackets 79 are secured to bottom wall 76 and are located adjacent a pair of tabs 81 secured to lift arm 23A. A transverse pivot pin 82 pivotally connects ears 81 to brackets 79. A second pair of ears or brackets 83 are located adjacent a pair of tabs 84 secured to lift arm end 24A. A transverse pin 86 pivotally connects ears 83 to tabs 84. Pin 86 is located along the pivot or transverse axis of pin 82.

Bucket 72 is tilted or pivoted about a generally horizontal transverse axis established by pins 82 and 86 with an extendable and contractible means or a double acting hydraulic piston and cylinder assembly indicated generally at 87. Assembly 87 has an elongated cylinder located between lift arms 23 and 24. The lower end or base end of cylinder 88 has a pair of ears 89 accommodating a pin 91 pivotally connecting ears 89 to a cross beam 92. Opposite ends of the cross beam 92 are secured by welds or the like to mid-portions of the lift arms 23 and 24. The rod or upper end of cylinder 88 accommodates a reciprocating piston rod 93. The outer end of rod 93 is connected to a cross head 94 with a bolt 96 or similar fastener. Cross head 94 has outwardly directed hubs or projections 97 and 98. Hub 97 is rotatably located in a bearing 99 secured to the mid-portion of an arm 101. The lower end of arm 101 is attached to a shaft 102 with a pin 103. Pin 103 can be a key or spline so that shaft 102 rotates in response to angular movement of arm 101. Shaft 102 is rotatably mounted in the outer end 23A of arm 23. The upper end of arm 101 carries a pivot pin 104 pivotally connecting arm 101 to a link 106. Link 106 extends upwardly to a pair of upright ribs 107 and 108 secured to back wall 74 of bucket 72. A transverse pin 109 pivotally connects link 106 to ribs 107 and 108.

An upright arm 111 is located adjacent the lift arm end 24A. The mid-section of arm 111 carries a bearing 112 accommodating the cross head hub 98. The lower end of arm 111 is secured to a shaft 113 mounted on lift arm end 24A. Shaft 113 is in alignment with shaft 102. The upper end of arm 111 carries a pivot pin 114 connected to a link 116. Link 116 extends upwardly between a pair of ribs 117 and 118 secured to the back wall 74 of bucket 72. A pin 119 pivotally connects link 116 to ribs 117 and 118. Pin 119 is aligned with the pin 109. When piston and cylinder assembly 97 is expanded, the piston rod 93 moves outwardly from cylinder 88 rotating arms 101 and 111 in a forward direction thereby pivoting bucket 72 in a clockwise direction. When the piston and cylinder assembly 87 is fully extended, the bucket is located in the dump position, as shown in broken lines in FIG. 3. When piston and cylinder assembly 87 is contracted, the bucket 72 pivots in a counterclockwise direction to a material holding position. The bucket 72 can be horizontally orientated or maintain a level in the material holding position with an automatic operating control hereinafter described.

Referring to FIG. 6, pump 55 is operable to supply fluid under pressure to a second control valve indicated generally at 121. Lines 58 and 68 are coupled to the valve 121. Opposite ends of cylinder 88 are connected to lines 129 and 131 leading to valve 121. Valve 121 has a linearly movable spool 122 having a plurality of longitudinally spaced grooves 123, 124, 125, and 126 movable relative to the ports for lines 58, 68, 129, and 131 to regulate the amount, as well as the direction, of the flow of fluid in lines 129 and 131. The longitudinal position of spool 122 is controlled with a manual actuating lever 127. Lever 127 extends upwardly from a shelf 132 located adjacent the right side of seat 121 and secured to frame 12. The valves 59 and 121 are located below shelf 132 and are secured to a portion of the frame 112.

Figure 2:
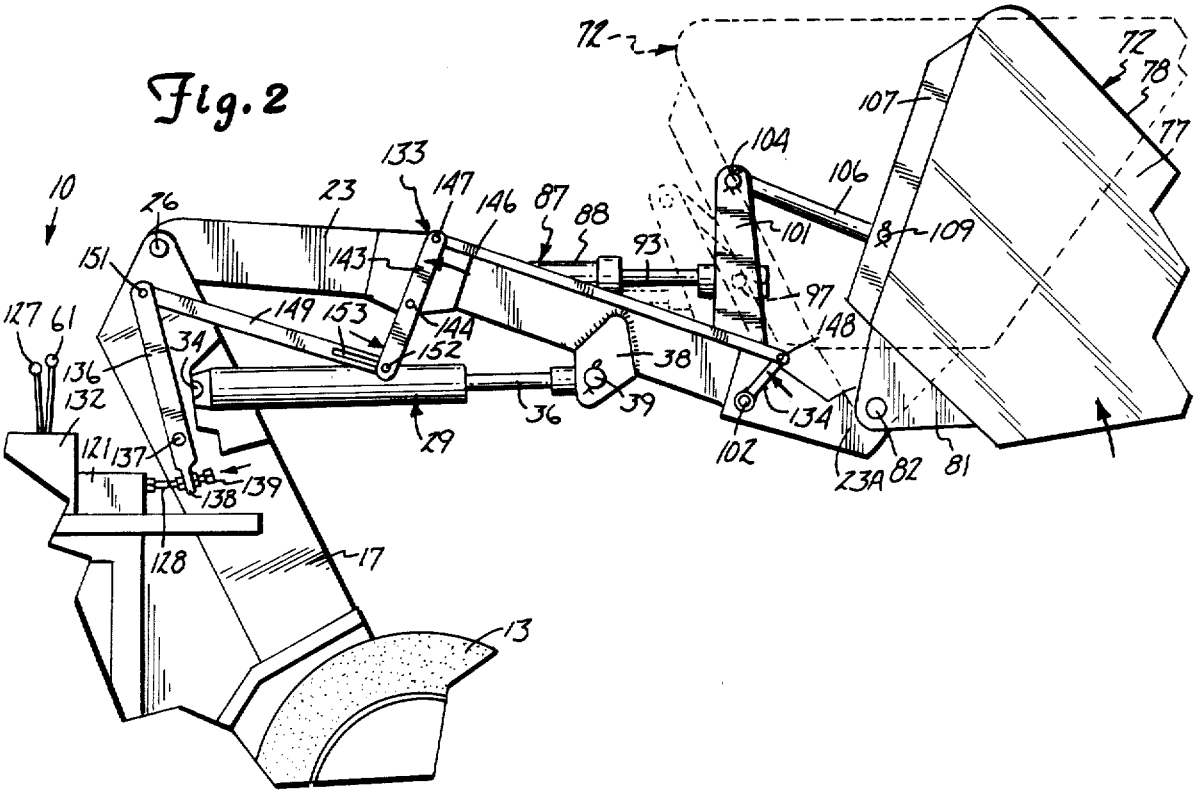
FIG. 2 is an enlarged fragmentary side elevational view of the forward end of the vehicle of FIG. 1 with the lift arms in their intermediate elevated positions.

A shown in FIGS. 2 and 7, a forwardly directed projection or finger 128 is connected to the forward end of spool 122. Finger 128 is operatively associated with a control means or motion transmitting linkage arrangement or assembly indicated generally at 133 operable to control the spool in a manner so that bucket 72 will remain in a selected orientation, such as substantially level, as bucket 72 is raised by lift arms 23 and 24 between the down position and up position thereof. Heretofore it has been the practice to manually operate valve 121 to control piston and cylinder assembly 87 in a manner to maintain bucket 72 level as it is moved from the down position to the up position. As lift arms 23 and 24 move up, the bucket 72 is rotated in a clockwise or forward direction to maintain the top edge 78 generally horizontal. This insures the maximum load carrying capacity of bucket 72. If the bucket 72 is not rotated on lift arms 23 and 24, the top edge 48 will slope rearwardly or toward the vehicle operator so that some of the material in the top of bucket 72 may fall onto the front of the vehicle and operator. The motion transmitting linkage assembly or mechanical linkage 133 operates to automatically actuate or feather the spool 122 of valve 121 in a manner to maintain bucket 72 generally level as lift arms 23 and 24 move the bucket 72 between up and down positions. Bucket 72 can also be retained in the level position during movement of the lift arms 23 and 24 from the up position to the down position. Motion transmitting linkage 133 does not interfere with the dumping of bucket 72 or forward tilting of the bucket 72, as shown in broken lines in FIG. 3.

As shown in FIG. 2, motion transmitting linkage assembly 133 has a first generally upright arm 134 secured to the outer end of shaft 102. Arm 134 extends generally parallel to the middle vertical transverse plane of the bucket 72 that includes the pivot axis of pins 82 and 86 on bucket 72 when the top of the bucket is in the horizontal or level position. Arm 134 angularly moves with the rotation of shaft 102. Shaft 102 is rotated in response to actuation of piston and cylinder assembly 87 which alters the tilt position of bucket 72. Linkage assembly 133 further includes a second arm 136 located adjacent the outside of post 17. A pivot axle or pin 137 pivotally connects the lower end of arm 16 to post 17. The bottom of second arm 136 has a flat end 138 formed by twisting the arm approximately 90 degrees. The flat end 138 accommodates a bolt 139 having a forward end 140 generally aligned with and engageable with spool finger 128. A pair of nuts 141 and 142 adjustably mount bolt 139 on end 138. Nuts 141 and 142 allow bolt 139 to be adjusted relative to lever 136 thereby providing an adjustment to control the level position of bucket 72 or orientation of bucket 72 relative to arms 23 and 24. Arms 134 and 136 are operatively connected to a lever 143 with a pair of links 146 and 149. A pivot pin 144 pivotally connects the center of lever 143 to the mid-section of lift arm 23. The upper end of lever 143 is connected with a pivot pin 147 to link 146. The forward end of link 146 is connected with a pivot pin 148 to the upper end of arm 134. Second link 149 is pivotally connected with a pivot pin 151 to the upper end of second arm 136. A pivot pin 152 extended through a lost motion slot 153 in link 149 joins link 149 to lever 143. Pivot pins 26, 144 and shaft 102 are generally aligned along a radial line from the pivot axis of pin 26. Pin 151 is located below arm pivot pin 26. Pin 137 is also located below arm pivot pin 26 and is in general vertical alignment with pin 26. The upper portion of second arm 136 between pivot pins 137 and 151 is longer than first arm 134. The lower portion of second arm 136 between pivot pin 137 and bolt 139 is shorter than first arm 134.

In use, referring to FIG. 1, lift arms 23 and 24 are in their down position to locate bucket 72 adjacent the surface or ground 16. Bucket 72 is tilted in its forward position so that the open end thereof faces the material, as a pile of fertilizer or lime, to be handled by bucket 72. The tilt position and cylinder assembly 87 rotates the bucket 72 in the forward direction until the forward edge of the front wall 73 of the bucket engages ground 16. The vehicle operator manipulates valve lever 127 to control piston and cylinder assembly 87. Vehicle 10 is then driven in a forward direction into the material, such as fertilizer, sand, lime, and the like. Bucket 72 is moved into the material to fill the chamber of the bucket. The tilt piston and cylinder assembly is then retracted to pivot or tilt bucket 72 to its first position 72A, as shown in broken lines in FIG. 1.

The lift arm valve 59 is actuated by the operator causing hydraulic fluid under pressure to flow to the lift arm piston and cylinder assemblies 29 and 31. The piston and cylinder assemblies 29 and 31 cause lift arms 23 and 24 to pivot in an upward direction. As the lift arms 23 and 24 move upward, bucket 72 moves to a level position. The motion transmitting linkage assembly 133 operates to move or feather spool 122 of the valve 121 to provide for an automatic controlled flow of hydraulic fluid under pressure to the piston and cylinder assembly 87 to maintain the bucket 72 in a selected position, as a level position, as the lift arms 23 and 24 pivot to their full up position, as shown in FIG. 3.

Referring to FIG. 2, as lift arms 23 and 24 are raised, first arm 134 is moved in a counterclockwise direction causing a similar movement of lever 143. Lever 143 pulls link 149 to the right causing clockwise movement of second arm 136. Bolt 139 when in engagement with the end of the finger 128 moves spool 122 relative to the housing for valve 121 thereby causing a feathering or small movement of the spool 122 allowing a limited amount of fluid to flow through line 129 to the base end of cylinder 88. This causes an expansion of the piston and cylinder 87 pivoting the bucket 72 in a clockwise direction to maintain the top edge 78 or bucket 72 thereof level or generally horizontal, as shown in broken lines.

Referring to FIG. 3, bucket 72 can be moved from a level position to a dump position, as shown in broken lines. This is achieved by the vehicle operator moving the control lever 127 to operate valve 121 in a manner to fully expand the piston and cylinder assembly 87. The piston rods 93 move out of cylinder 88 pivoting arms 101 and 111 in a clockwise direction. This rotates bucket 72 clockwise to its dump position. Arm 134 of the motion transmitting linkage assembly 133 rotates clockwise with shaft 102. As the arm 134 rotates it moves pivot pin 148 over center with respect to pivot pin 147 and shaft 102. In other words, pivot pin 148 moves below a line passing through axis of shaft 102 and pivot pin 147. The over center movement of arm 134 limits the amount of movement of lever 143 when bucket 77 is moved to the dump position. Lever 143 being connected to link 149 via lost motion slot 153 can move clockwise without moving link 149 or arm 136. The over center rotation of arm 134 combined with the lost motion slot 153 allows bucket 77 to be pivoted to the dump position without affecting the operation of valve 121, as motion is not transmitted to second arm 136.

Lift arms 23 and 24 can be moved from their up position, as shown in FIG. 3, to the down position, as shown in FIG. 1, by contracting the lift piston and cylinder assemblies 29 and 31. This is achieved by the opposite or forward movement of the control lever 61 for valve 59. Bucket 72 can remain in the dump position or be pivoted back ot its level position by operation of the piston and cylinder assembly 87. This is achieved by the movement of lever 127 of the control valve 121 in a forward direction. When lift arms 23 and 24 are in their down position, bucket 72 can then be pivoted in the forward direction, as shown in FIG. 1, so that bucket 72 can be driven into a pile of material for a second material handling operation.

While there has been shown and described an embodiment of a material handling vehicle equipped with lift arms and a material carrying bucket, it is understood that changes in the vehicle, lift arm structure, and bucket can be made by those skilled in the art without departing from the bucket tilt control system of the invention. For example, the tilt control for the bucket can be used with other types of vehicles and material handling equipment to maintain a load carrying means in a selected orientation, such as a level position. The invention is defined in the following claims.

The embodiments of the invention in which an exclusive property or privilege is claimed are defined as follows:

1. A vehicle comprising: a frame having generally upright post means, wheel means operably connected to the frame to support the frame from movement on the ground, means for driving at least one of said wheel means, lift arm means, first pivot means pivotally connecting the lift arm means to the post means, power means connected to the frame and lift arm means operable to move the lift arm means from a down position to an up position, material accommodating means, second pivot means pivotally mounting the material accommodating means on the lift arm means, expandable and contractible means connected to the lift arm means, means pivotally mounted on the lift arm means and material accommodating means and connected to the expandable and contractible means operable to pivot the material accommodating means on the lift arm means for movement between a material holding position and a dump position, means for controlling the expansion and contraction of said expandable and contractible means thereby controlling the position of the material accommodating means relative to the lift arm means, and control means operably connecting the second pivot means and expandable and contractible means, said control means being operable in response to relative movement between the lift arm means and post means and relative movement between the material accommodating means and lift arm means in a manner to maintain the material accommodating means in a material holding position during the movement of the lift arm means between said down position and up position, said control means including a first arm, a second arm, linkage means operably connecting the first and second arms, said linkage means including lost motion means allowing the expandable and contractible means to pivot the material accommodating means from the material holding position to a dump position without affecting the operation of the means for controlling the expansion and contraction of said expandable and contractible means, said first arm being connected to and movable with the means pivotally mounted on the lift arm means, said second arm means being pivotally mounted on the post means, said second arm means having means cooperating with said means for controlling the expansion and contraction of said expandable and contractible means whereby on movement of said lift arm means said second arm is moved to actuate the means for controlling the expansion and contraction of said expandable and contractible means in a manner to control the position of the material accommodating means, said first arm being rotatable in response to movement of the material accommodating means between a first position when the material accommodating means is in the material retaining position and an over center position when the material accommodating means is in the dump position.

2. The vehicle of claim 1 wherein: said means on the second arm cooperating with the means for controlling the expansion and contraction of said expandable and contractible means includes an adjustable member selectively movable to adjust the material holding position of the material accommodating means.

3. The vehicle of claim 1 wherein: said linkage means includes a lever pivotally mounted on said lift arm means, a first link connecting said lever to said first arm and a second link connecting said lever to said second arm.

4. The vehicle of claim 3 wherein: said lever and second link have said lost motion means allowing limited relative movement between said lever and second link to allow the material accommodating means to be moved to the dump position without affecting the means for controlling the expansion and contraction of said expandable and contractible means.

5. The vehicle of claim 1 wherein: said expandable and contractable means is a double acting piston and cylinder assembly, said means for controlling the expansion and contraction of said expandable and contractible means including a valve means for controlling the flow of fluid under pressure to said piston and cylinder assembly thereby controlling the material holding position of the material accommodating means.

6. The vehicle of claim 5 wherein: said means on the second arm comprises an adjustable member cooperating with said valve means, said adjustable member being movable to a selected position to adjust the material holding position of the material accommodating means.

7. The vehicle of claim 6 wherein: said valve means includes a movable spool and a finger connected to said spool, said adjustable member being engageable with the finger whereby pivotal movement of the second arm moves the spool thereby controlling the flow of fluid to and from said piston and cylinder assembly.

8. The vehicle of claim 5 wherein: said material accommodating means is a bucket having an open top.

9. The vehicle of claim 1 wherein: said post means have upper end portions, said first pivot means pivotally connecting the lift arm means to said upper end portions, and said control means including at least one arm pivotally mounted on said post means.

10. A material handling apparatus comprising: a frame, lift means, first pivot means pivotally connecting the lift means to the frame, power means connected to the frame and lift means operable to move the lift means from a down position to an up position, material accommodating means, second pivot means pivotally mounting the material accommodating means on the lift means, expandable and contractible means connected to the lift means and material accommodating means to pivot the material accommodating means on the lift means for movement between a material holding position and a dump position, means including a third rotatable pivot means connecting the expandable and contractible means to the material accommodating means, means for controlling the expansion and contraction of said expandable and contractible means thereby controlling the position of the material accommodating means relative to the lift means, and control means operably connecting the third pivot means and means for controlling the expansion and contraction of said expandable and contractible means, said control means being operable in response to relative movement between the lift means and frame and relative movement between the material accommodating means and lift means in a manner to maintain the material accommodating means in a material holding position during the movement of the lift means between said down position and up position, said control means including a first arm connected to the third pivot means and rotatable therewith between a first position when the material accommodating means is in the material retaining position and an over center position when the material accommodating means is in the dump position, a second arm, linkage means operably connecting the first and second arms, said linkage means having lost motion means allowing limited relative movement between said first and second arms to permit the material accommodating means to be moved to the dump position without affecting the means for controlling the expansion and contraction of said expandable and contractible means, said second arm being mounted on the frame.

11. The apparatus of claim 10 wherein: said second arm includes means cooperating with said means for controlling the expansion and contraction of said expandable and contractible means whereby on movement of said lift means said second arm is movable to actuate the means for controlling the expansion and contraction of said expandable and contractible means in a manner to control the position of the material accommodating means.

12. The apparatus of claim 11 wherein: said means on the second arm cooperating with the means for controlling the expansion and contraction of said expandable and contractible means includes an adjustable member selectively movable to adjust the material holding position of the material accommodating means.

13. The apparatus of claim 10 wherein: said linkage means includes a lever pivotally mounted on said lift means, a first link connecting said lever to said first arm and a second link connecting said lever to said second arm.

14. The apparatus of claim 13 wherein: said lever and second link have said lost motion means allowing limited relative movement between said lever and second link to allow the material accommodating means to be moved to the dump position without affecting the means for controlling the expansion and contraction of said expandable and contractible means.

15. The apparatus of claim 10 wherein: said expandable and contractable means is a double acting piston and cylinder assembly, said means for controlling the expansion and contraction of said expandable and contractible means including a valve means for controlling the flow of fluid under pressure to said piston and cylinder assembly thereby controlling the material holding position of the material accommodating means.

16. The apparatus of claim 15 wherein: said second arm includes an adjustable member cooperating with said valve means, said adjustable member being movable to a selected position to adjust the material holding position of the material accommodating means.

17. The apparatus of claim 16 wherein: said valve means includes a movable spool and a finger connected to said spool, said adjustable member being engageable with the finger whereby pivotal movement of the second arm moves the spool thereby controlling the flow of fluid to and from said piston and cylinder assembly.

18. The apparatus of claim 11 wherein: said material accommodating means is a bucket having an open top.

19. The apparatus of claim 11 wherein: said frame includes posts having upper end portions, said first pivot means pivotally connecting the lift means to said upper end portions.

20. The apparatus of claim 10 including: wheel means mounted on the frame for supporting the frame on a surface.

21. The apparatus of claim 10 including: a plurality of wheel means mounted on the frame for supporting the frame on a surface, motor means connected to at least one of said wheel means operable to apply torque to said one wheel means to move said apparatus relative to said surface.

22. The apparatus of claim 10 wherein: said lift means comprise lift arms having opposite ends, said first pivot means pivotally connecting one end of the lift arms to said frame for pivotal movement about a generally horizontal axis, said material accommodating means comprising a bucket, said second pivot means pivotally connecting said bucket to the other end of the lift arms.

23. The apparatus of claim 22 wherein: said control means is operable to maintain the bucket substantially level during movement of the lift arms between up and down positions.

24. A control for maintaining a selected orientation of a material holding means during movement of said material holding means between up and down positions, means pivotally mounting the material holding means on lift means, said lift means being movably mounted on frame means for movement between up and down positions, power means for selectively moving the lift means between said up and down positions, fluid operated means connected to the lift means and material holding means operable to selectively move the material holding means to a first material retaining position and a second material discharge position, means for supplying fluid under pressure, and valve means for controlling the flow of fluid from the means for supplying fluid under pressure to the fluid operated means whereby the fluid operated means on actuation of said valve means functions to selectively move the material holding means to and from the first material retaining position and the second material discharge position, comprising: first means movably mounted on the lift means movable in response to pivotal movement of the material holding means relative to the lift means, second means movably mounted on the frame means, said second means having means cooperating with said valve means for actuating said valve means in response to movement of the second means, and linkage means operably connecting the first means and second means to move the second means to actuate said valve means in response to movement of the lift means and in response to relative movement between the lift means and material holding means, said valve means being actuated by the second means to control the flow of fluid to said fluid operated means in a manner to maintain a selected orientation of the material holding means, said first means including an arm, means connecting the linkage means to said arm, shaft means rotatably mounted on the lift means, means connecting the shaft means to the material holding means, said arm being secured to and movable with the shaft means between a first position when the material holding means is in the material retaining position and an over center position when the material holding means is in the discharge position.

25. The control of claim 24 including: first pivot means pivotally mounting the first means on the lift means, and second pivot means pivotally mounting the second means on the frame means.

26. The control of claim 25 wherein: said first means is a first arm connected to the first pivot means, and said second means is a second arm mounted on the second pivot means, said second arm having a portion thereof attached to said means cooperating with said valve means.

27. The control of claim 24 wherein: said means cooperating with said valve means comprises an adjustable member movable to a selected position to adjust the orientation of the material holding means.

28. The control of claim 27 wherein: said valve means includes a movable spool and a finger connected to said spool, said adjustable member being engageable with the finger whereby on movement of the second means the spool moves thereby controlling the flow of fluid to and from said fluid operated means.

29. The control of claim 24 wherein: said linkage means includes lost motion means allowing the fluid operated means to pivot the material holding means from the material holding position to the material discharge position.

30. The control of claim 24 wherein: said linkage means includes a lever pivotally mounted on said lift means, a first link connecting said lever to said first means and a second link connecting said lever to said second means.

31. The control of claim 30 wherein: said lever and second link have lost motion means allowing limited relative movement between said lever and second link to allow the material holding means to be moved to the material discharge position without affecting the second means.

32. The control of claim 30 wherein: said means cooperating with said valve means comprises an adjustable member movable to a selected position to adjust the orientation of the material holding means.

33. The control of claim 32 wherein: said valve means includes a movable spool and a finger connected to said spool, said adjustable member being engageable with the finger whereby on movement of the second means the spool moves thereby controlling the flow of fluid to and from said fluid operated means.

34. The control of claim 24 wherein: said linkage means includes lost motion means which cooperate with the over center movement of said arm to permit movement of the material holding means from the material retaining position to the material discharge position without affecting the operation of said valve means with the second means.

35. The control of claim 24 wherein: said linkage means includes a lever pivotally mounted on said lift means, a first link pivotally connected to said arm and lever, and a second link pivotally connected to said second means.

36. The control of claim 35 wherein: said lever and second link have lost motion means which cooperate with the over center movement of said arm to permit movement of the material holding means from the material retaining position to the material discharge position without affecting the operation of said valve means with the second means.

37. The control of claim 36 wherein: the second means includes a second arm pivoted to the frame means.

38. A material handling apparatus comprising: a frame, lift means, first pivot means pivotally connecting the lift means to the frame, power means connected to the frame and lift means operable to move the lift means from a down position to an up position, material accommodating means, second pivot means pivotally mounting the material accommodating means on the lift means, expandable and contractible means connected to the lift means and material accommodating means to pivot the material accommodating means on the lift means for movement between a material holding position and a dump position, means including a third rotatable pivot means connecting the expandable and contractible means to the material accommodating means, means for controlling the expansion and contraction of said expandable and contractible means thereby controlling the position of the material accommodating means relative to the lift means, and control means operably connecting the third pivot means and means for controlling the expansion and contraction of said expandable and contractible means, said control means including arm means secured to the third pivot means and link means pivoted to the arm means, said arm and link means being movable from a first position when the material accommodating means is in the material holding position to a second position over center of the third pivot means when the material accommodating means is in the dump position, said control means being operable in response to relative movement between the lift means and frame and relative movement between the material accommodating means and lift means to operate the means for controlling the expansion and contraction of said expandable and contractible means in a manner to maintain the material accommodating means in a material holding position during the movement of the lift means between said down position and up position and to allow the material accommodating means to be moved to the dump position without affecting the operation of the means for controlling the expansion and contraction of said expandable and contractible means.

39. The apparatus of claim 38 wherein: said control means includes a first arm, a second arm, linkage means operably connecting the first and second arms, said first arm being connected to and movable with the means pivotally mounted on the lift means between said first and second positions thereof, said second arm being pivotally mounted on the frame, said second arm having means cooperating with said means for controlling the expansion and contraction of said expandable and contractible means whereby on movement of said lift means said second arm is movable to actuate the means for controlling the expansion and contraction of said expandable and contractible means in a manner to control the position of the material accommodating means.

40. The apparatus of claim 39 wherein: said linkage means includes lost motion means allowing the expandable and contractible means to pivot the material accommodating means from its material holding position to a dump position.

41. The apparatus of claim 39 wherein: said means on the second arm cooperating with the means for controlling the expansion and contraction of said expandable and contractible means includes an adjustable member selectively movable to adjust the material holding position of the material accommodating means.

42. The apparatus of claim 39 wherein: said linkage means includes a lever pivotally mounted on said lift means, a first link connecting said lever to first arm and a second link connecting said lever to said second arm.

43. The apparatus of claim 42 wherein: said lever and second link have lost motion means allowing limited relative movement between said lever and second link, said relative movement allowed by the lost motion means cooperating with the over center movement of the first arm to allow the material accommodating means to be moved to the dump position without affecting the means for controlling the expansion and contraction of said expandable and contractible means.

44. The apparatus of claim 43 wherein: said expandable and contractible means is a double acting piston and cylinder assembly, said means for controlling the expansion and contraction of said expandable and contractible means including a valve means for controlling the flow of fluid under pressure to said piston and cylinder assembly thereby controlling the material holding position of the material accommodating means.

45. The apparatus of claim 44 wherein: said means on the second arm comprises an adjustable member cooperating with said valve means, said adjustable member being movable to a selected position to adjust the material holding position of the material accommodating means.

46. The apparatus of claim 45 wherein: said valve means includes a movable spool and a finger connected to said spool, said adjustable member being engageable with the finger whereby pivotal movement of the second arm moves the spool thereby controlling the flow of fluid to and from said piston and cylinder assembly.

47. The apparatus of claim 42 wherein: said lift means comprise lift arms having opposite ends, said first pivot means pivotally connecting one end of the lift arms to said frame for pivotal movement about a generally horizontal axis, said material accommodating means comprising a bucket, said second pivot means pivotally connecting said bucket to the other end of the lift arms.

* * * * *